US005348702A

United States Patent [19]

Matsuo et al.

[11] Patent Number: 5,348,702

[45] Date of Patent: Sep. 20, 1994

[54] PROCESS FOR PRODUCING $\gamma$ AND $\beta$ DUAL PHASE TIAL BASED INTERMETALLIC COMPOUND ALLOY

[75] Inventors: Munetsugu Matsuo; Naoya Masahashi; Keizo Hashimoto; Toshihiro Hanamura; Hideki Fujii, Kawasaki; Masao Kimura; Youji Mizuhara, all of Kawasaki; Hiroo Suzuki, Sagamihara, all of Japan

[73] Assignee: Nippon Steel Corporation, Tokyo, Japan

[21] Appl. No.: 26,707

[22] Filed: Mar. 5, 1993

Related U.S. Application Data

[62] Division of Ser. No. 742,846, Aug. 8, 1991, Pat. No. 5,232,661.

[30] Foreign Application Priority Data

Jan. 31, 1991 [JP] Japan ..... 3-98322

[51] Int. Cl.[5] ..... C22C 14/00

[52] U.S. Cl. ..... 420/421; 148/421; 148/671; 420/417; 420/419

[58] Field of Search ..... 148/421, 671; 420/417, 420/419, 421

[56] References Cited

U.S. PATENT DOCUMENTS

| | | | |
|---|---|---|---|
| 4,842,819 | 6/1989 | Huang et al. | 420/418 |
| 5,028,277 | 7/1991 | Mizoguchi et al. | 420/418 |
| 5,028,491 | 7/1991 | Huang et al. | 420/418 |
| 5,190,603 | 3/1993 | Nazmy et al. | 148/671 |

FOREIGN PATENT DOCUMENTS

| | | |
|---|---|---|
| 0365174 | 4/1990 | European Pat. Off. . |
| 63-171862 | 7/1988 | Japan . |
| 64042539 | 2/1989 | Japan . |
| 01259139 | 10/1989 | Japan . |

OTHER PUBLICATIONS

Z. Metallkde, vol. 81, H. 11, Nov. 1990, W. Wunderlich et al. pp. 802–808.

Metallurgical Transactions A, vol. 19A, Oct. 1988, pp. 2445–2455, D. Vujic et al.

Abstract of Autumn Symposium Of The Japan Institute Of Metals (1989) S7.18, N. Maeda et al.

Abstract of Autumn Symposium Of The Japan Institute Of Metals, (1989) S.7.22, M. Shinki et al.

Material Of 53rd Meeting Of Superplasticity, Jan., 1990, N. Maeda.

Abstract Of General Lecture In Autumn Symposium Of The Japan Institute of Metals, Nov. 1988, 576, S. Noda et al.

*Primary Examiner*—Upendra Roy

*Attorney, Agent, or Firm*—Kenyon & Kenyon

[57] ABSTRACT

This invention relates to TiAl based intermetallic compound alloy and process for producing; the object of this invention is to improve high temperature deformability. The alloy comprises basic components: $Ti_YAlCr_X$, wherein $1\% \leqq X \leqq 5\%$, $47.5\% \leqq Y \leqq 52\%$, and $X+2Y \geqq 100\%$, and comprises a fine-grain structure with a $\beta$ phase precipitated on a grain boundary of equiaxed $\gamma$ grain having grain size of less than 30 $\mu$m, and possessing a superplasticity such that the strain rate sensitivity factors (m value) is 0.40 or more and tensile elongation is 400% or more tested at 1200° C. and a strain rate of $5 \times 10^{-4} S^{-1}$.

3 Claims, 6 Drawing Sheets

PROCESS FOR PRODUCING $\gamma$ AND $\beta$ DUAL PHASE TIAL BASED INTERMETALLIC COMPOUND ALLOY This application is a division of Ser. No. 07/742,846, filed Aug. 8, 1991, now U.S. Pat. No. 5,232,661.

BACKGROUND OF THE INVENTION

1. Field of the Invention

This invention relates to a TiAl based intermetallic compound alloy comprising $\gamma$ and $\beta$ phases having a supermicrostructure and a process for producing same.

2. Description of the Related Art

Among intermetallic compounds, many compounds have specific properties which a single phase metal does not possess and there have been investigated for application as functional and/or constructional materials. For example, since $Ni_3Al$, TiAl and the like have a strong positive temperature-dependency of strength, they have been increasingly expected to be applied as heat-resistant materials. In particular, TiAl, which has a low density of 3.8 g/cm$^3$, has been investigated for application to aircraft materials. Most of the intermetallic compounds including TiAl have a poorer deformability than general metals, and thus many investigations into an improving of their ductilities have been made.

Concerning the TiAl based intermetallic compounds, techniques wherein Cr is added as the third element for improving the ductility are disclosed in U.S. Pat. No. 4,842,819, Japanese Unexamined Patent Publication (Kokai) No. 64-42539, Japanese Unexamined Patent Publication (Kokai) No. 1-259139, etc., but these are all intended only for a grain refining by the addition of Cr.

In addition to the alloy design by alloying, an attempt to control the microstructure by a thermomechanical treatment has been made to thus improve the deformability. For example, isothermal forging process for TiAl binary alloy has been disclosed (Japanese Unexamined Patent Publication (Kokai) No. 63-171862.) Through isothermal forging, equiaxed grains having 10–20 $\mu$m diameter were obtained. Although these microstructure controlled samples have a high deformation stress at 800° C., the room temperature ductility was not improved. Further, it has been reported that an intermetallic compound Ti-33.5% Al-2% Mo-0.05% B-0.09% O in weight was thermomechanically treated (hot-extrusion followed by isothermal forging) for grain refinement and the mechanical properties at high temperature were examined, which showed a superplastic deformation behavior exceeding 80% tensile elongation at 800° C. (Abstract of Autumn Symposium of The Japan Institute of Metals (1989), pp.238). Nobuki et al., reported that the microstructure controlled by isothermal forging samples, having a 13 $\mu$m grain, which composition was Ti-35% Al in weight, showed a higher m value (strain rate sensitivity factor) over 0.3 and had a high temperature strength. Further, it was reported that, when the temperature was controlled within the range of 887°–1047° C., repeated sudden temperature change at a strain rate of $10^{-3}S^{-1}$, allowed a 220% fracture point to be obtained (Abstract of Autumn Symposium of The Japan Institute of Metals (1989), pp.245).

Further, the technique wherein a TiAl based intermetallic compound alloyed with Mo as the third element is isothermal forged to precipitate a $\beta$ phase in the $\gamma$-grains, was reported in the Material of 53th Meeting of Superplasticity (Jan. 30, 1990, pp. 1–5). According to this report, the compound had an m value higher than 0.3 only in the case of a strain rate lower than $5\times10^{-4}$ sec$^{-1}$ at 1273 K, and the best value was 230% .

It is well known that a TiAl based intermetallic compound alloy has a low ductility at room temperature, and does not possess a good workability even at high temperatures, in comparison with that of usual alloys. As disclosed in Abstract of Autumn Symposium of The Japan Institute of Metals (1989), page 245, one of the above-mentioned references, even if such special heating-cooling treatments are applied with repeated sudden temperature variations in the range of between 887° C. and 1047° C., at a fixed strain rate the $10^{-3}S^{-1}$ is 220% at most. Furthermore, according to the report of the Material of the 53th Meeting of Superplasticity, the optimum data for a tensile elongation tested at 1273 K (about 1000° C.) at a strain rate lower than $5\times10^{-4-1}$ (the report did not clearly show the strain rate, but generally the lower the strain rate the greater the elongation at fracture.) was as low as 230% .

As described above, since a TiAl based intermetallic compound has characteristics such as a light weight, good heat resistance and high strength, the application thereof, for example, to the material forming the main parts of supersonic airplanes and spacecraft in the space fields, and automotive parts such as the valve material for automobile engines and turbocharger rotors, has been expected, and there is a need to further improve the workability.

An object of this invention is to provide a novel TiAl based alloy having a high fracture elongation and an m value which cannot be obtained by the prior art technique and a process for producing the same.

Another object of this invention is to provide a TiAl based alloy having an enhanced yield strength inherent to the TiAl based alloy.

SUMMARY OF THE INVENTION

The inventors made an intensive study of a TiAl based intermetallic compound alloy (hereinafter referred to as "TiAl based alloy") to solve the above-mentioned object, and as a result, found that when Cr as the third component is added followed by within a specific range of Ti-Al binary composition alloy, a homogeneous heat treatment and a working treatment at a prescribed temperature, a $\beta$ phase is precipitated on a grain boundary of refined $\gamma$ grains, thereby easily providing the superplastic behavior due to the elongation effect of a $\beta$ phase and the grain refining effect of this alloy. Accordingly, a Ti-Al based alloy can be successfully worked and deformed.

That is, this invention comprises a $\gamma$ and $\beta$ dual phase TiAl based intermetallic alloy which comprises basic components in the atomic rate: $Ti_yAlCr_x$, wherein $1\%\leqq X\leqq5\%$ , $47.5\%\leqq Y\leqq52\%$ , and $X+2Y\leqq100\%$ , and which is a dual phase alloy comprised of an equiaxed $\gamma$-grain and has a grain size of less than 30 $\mu$m without detects such as voids, and a $\beta$ phase precipitated on the grain boundary, which alloy satisfies the criteria of the superplasticity behavior. The Cr-added TiAl based alloy mentioned above, which can be superplastically worked, can be obtained by applying a homogeneous heat treatment by keeping the temperature at 1000° C. or more and below the solidus temperature for 2 to 100 hours, and then carrying out a high temperature working, for example, an isothermal forging at a temperature of higher than 1100° C. and at a strain rate of less than $5\times10^{-2}S^{-1}$, and at a working degree of higher than 60% .

The results of the investigation into obtaining a Ti-Al based intermetallic compound having a superior deformability at high temperatures, by controlling the composition and the microstructure will now be described. First, in the case of the TiAl binary system, the TiAl ($\gamma$) phase forms a single phase region at room temperature, when it contains 49–55% (atomic % , hereinafter % having this meaning) of Al at room temperature. In contrast, a composition having a better deformability at room temperature has a 40–49% Al content, which alloys show a lamellar structure composed of $Ti_3Al$ ($\alpha_2$) and the $\gamma$ phase, each phases precipitate layer by layer alternatively. According to the general abstract of Autumn Meeting of The Japan Institute of Metals, a fine lamellar structure is not formed with higher volume of the $\alpha_2$ phase and also the room temperature deformability is maximum at 47–49% Al. Nevertheless, since the lamellar phase is unstable and transformed into another phase at a temperature of above 1185° C., it thus cannot be applied to the present invention, which aims to obtain a high temperature deformability.

Further, since oxygen and hydrogen reduce the Ti alloy deformability, it is also necessary to make the pick-up of oxygen and hydrogen as low as possible at the ingot stage in the case of this invention.

Accordingly, an ingot of the Δ-single phase high purity TiAl binary material containing 49.6% of Al concentration, 0.007 wt % of oxygen and 0.0005 wt % of hydrogen was prepared and its microstructure and mechanical properties were examined. The homogeneous heat treatment at 1050° C. for 48 hours brought heterogenous large grains of approximately 100–200 μm. As a result of a tensile test at high temperatures, the samples had an elongation value of 50% at about 1000° C. but showed necking, accordingly, these samples were considered to lack a high temperature deformability, i.e., did not show a superplasticity.

Next, the isothermal forging was carried out to the above homogeneous heat treated samples to control the grain size by dynamic recrystallization, which was attained at a temperature higher than the recrystallization temperature of the TiAl intermetallic compound and at a low strain rate. As a result, fine equiaxed grains of 25 μm or less were obtained, but when subjected to a tensile test at a high temperature (800°–1000° C.), they had only a 170% tensile elongation at 1000° C.

Next, the present inventor added Cr to TiAl intermetallic compound and as a result, the grain size became finer in comparison with the above-mentioned TiAl binary intermetallic compound and a fine equiaxed structure having a grain size of 40 μm was obtained by a heat treatment for homogenization. In this case, it is preferable to adapt the following method, using high purity starting material and reducing any contamination of the ingot and high probability of an alloy composition in the process of melting.

Subsequently, thermomechanical treatments were applied to the homogeneous heat treated TiAl-Cr alloy as described above. And it showed surprising high superplastic behavior, the strain rate sensitivity factor (m value) at 1200° C. and at a strain rate of $5\times10^{-4}s^{-1}$ was higher than 0.40 and the tensile elongation should higher than 400% , if an alloy having specified composition was subjected to the prescribed homogeneous heat treatment and thermomechanical treatments.

BRIEF DESCRIPTION OF THE DRAWINGS

FIG. 1 (*b*) is an magnified micrograph of (*a*);

FIG. 1 (*c*) is an micrograph of the portion of (*b*) by a transmission electron microscope (TEM) observation;

DESCRIPTION OF THE PREFERRED EMBODIMENTS

Figure 1A:
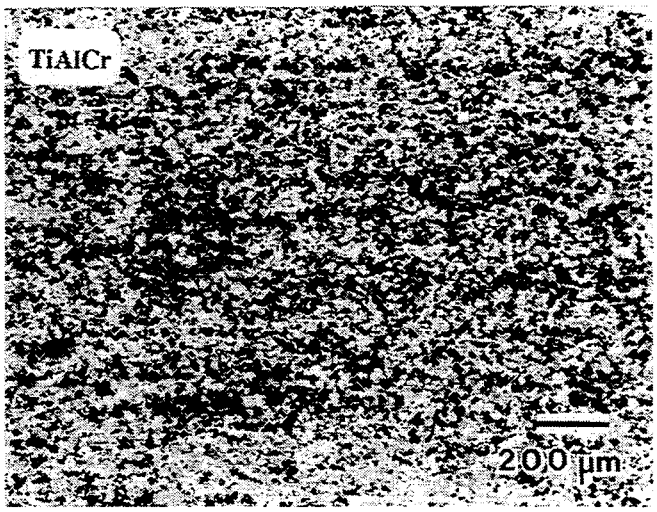
FIG. 1 (*a*) is a micrograph showing the microstructure of the alloy of the present invention after isothermal forging.

The following experiments were conducted. A binary TiAl intermetallic sample (A) and a Cr-added TiAl based alloy sample (B) were selected. Ingots were made by plasma arc melting so that the target composition of the compositions was set to Ti-50 at. % Al and Ti-47 At. % Al--3 at. % Cr, respectively. After a homogeneous heat treatment at 1050° C. for 96 hours, 35 mm diameter×42 mm height were cut off by electron discharge machining for thermomechanical treatment. In the present invention, the following isothermal forging was applied as thermomechanical treatment. Graphite was used as the mold of the isothermal forging and the furnace temperature was set to 1200° C. or 1300° C. under a vacuum atmosphere at about $10^{-4}$ Torr. The initial strain rate was set to $10^{-4}s^{-1}$ and the reduction rate was varied between 60 and 80% . The test pieces for the tensile test, having a gauge portion of $11.5\times3\times2$ $mm^3$, were prepared from the TiAl and TiAlCr microstructures controlled samples and the tensile test was conducted at a temperature of from room temperature to 1200° C. at varied strain rate from $5.4\times10^{-4}s^{-1}$ to $5.4\times10^{-2}s^{-1}$.

From the microscope observation of samples (A) and (B) after the respective treatments described above the following results were obtained:

(1) in the case of an ingot prepared by plasma arc melting, both of the samples (A) and (B) had a ($\gamma+\alpha_2$) lamellar structure;

(2) after the homogeneous heat treatment, in both samples, the lamellar structure disappeared and equiaxed grains were formed. Grain size of (A) was 100–200μm and that of sample (B) was about 100μm, respectively;

(3) after isothermal forging, both samples showed refined structure due to recrystallization Grain size of (A) was 25 μm and that of sample (B) was 18 μm, respectively.

The isothermal forging was conducted in the following condition, 60% of the working degree, $5\times10^{-4}s^{-1}$ of the initial strain rate and 1200° C. of the forging temperature. On the other hand, in the case of sample (B), the working and the initial strain rates were the same as those of sample (A) but the forging temperature was set at 1300° C. The reason for the different forging temperatures between sample (A) and sample (B) is based on some speculation that sample (A) has a higher grain growth rate after recrystallization and results in a difficulty of having superplasticity by grain refinement. That is, it was confirmed in the binary TiAl that the grain size 54.0 μm at the forging temperature of 1300° C. was larger than that obtained in the case of the forging temperature at 1200° C. (25.0 μm). On the other hand, graingrowth of sample (B) was not observed at even high forging temperature like 1300° C. and its grain size was smaller than that of sample (A).

Figure 1B:
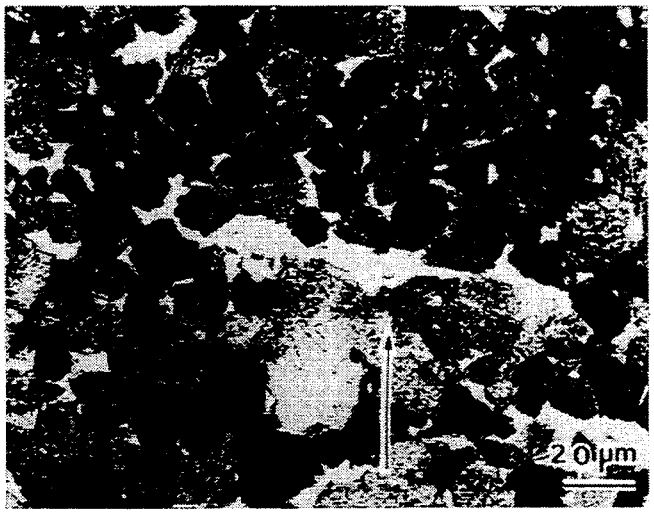
Figure 1C:
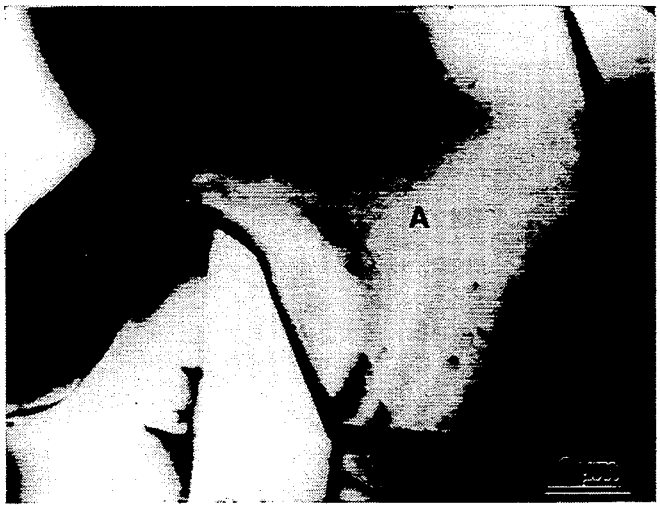
Figure 2A:
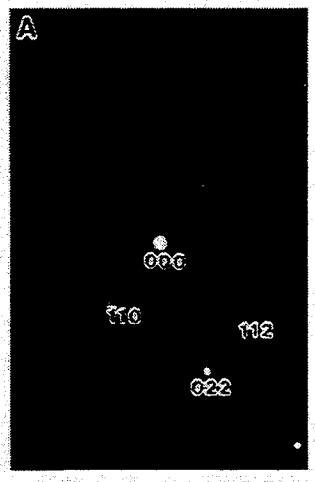
FIG. 2 is selected area diffraction (SAD) images of a matrix (A) and secondary phase at a grain boundary (B) of the isothermal forging material of the present invention alloy.
Figure 2B:
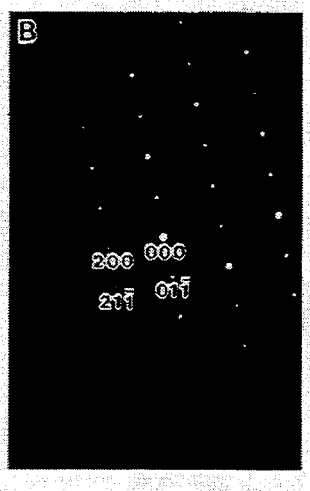
Figure 3:
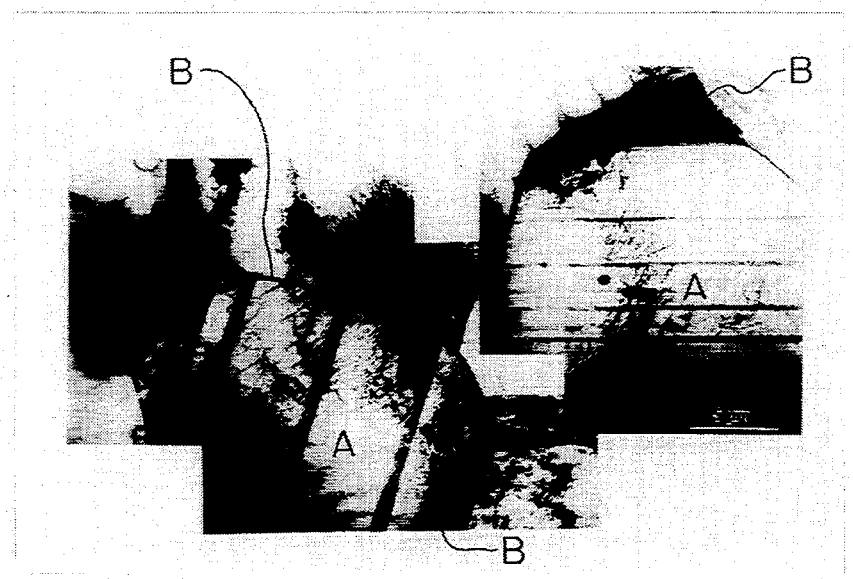
FIG. 3 is a micrograph of high temperature tensile fractured specimen tip of this present invention alloy by a high voltage transmission electron microscope (HVEM)

And it should be noted that a new phase was found at γ-grain boundaries. FIG. 1 (*a*) shows a optical micrograph recrystallization state in sample (B). In the suggesting of the grain boundary vicinity of the recrystallized grains, different phase from the y was observed as shown in FIG. 1 (*b*). FIG. 1 (*c*) is a transmission electron microscope microstructure of the portion containing this grain boundary secondary phase (B) and the matrix phase (A). A secondary phase with a thickness of several microns is recognized in the grain boundary. Further characterization by the combination of transmission electron microscope (TEM) observation, energy diffusion type X-ray diffraction (EDX) analysis and selected area diffraction (SAD), identified this phase as Cr-rich bcc β phase . FIG. 2 is selected area diffraction (SAD) image of a matrix phase (denoted as A in this figure) and a grain boundary secondary phase (denoted as B in this figure), respectively which was observed in FIG. 1 (*c*). From this SAD pattern, it was identified that the matrix in FIG. 1 (*c*) was TiAl phase (FIG. 2 (*a*)) and the grain boundary secondary phase was the β phase (FIG. 2(*b*)). The numerals expressed in FIGS. 2 (*a*) and (*b*) are lattice plane indices corresponding to black reflections, respectively.

(4) In the tensile test, sample (A) shows 135% fracture elongation at 1200° C. and at a strain rate of $5.4\times10^{-4}s^{-1}$ while sample (B) shows more than 400% fracture elongation under the same conditions. HVEM observation for fersiled specimen surface and cross section of sample (B) revealed β phase deformation along the all γ grain boundaries and also low dislocation density in γ matrix. In this figure, the symbols A and B denote the TiAl phase and the β phase , respectively, and the parallel lines found in TiAl matrix are a stacking fault. It can be considered from these observation that the recrystallized grains are prevented from coarsening by β phase precipitated at grain boundaries and so this β phase act as a lubricant for grain boundary sliding. It may be deduced that this at high temperature deformation caused outstanding large elongation described above.

As described above, the content of the present invention resides in that homogenizing heat treatment is carried out followed by isothermal forging is carried out for a Cr additioned TiAl intermetallic compound (γ phase ) in a high temperature region, especially at a temperature of 1100° C. or higher, preferably 1200° C. or more, to form a β-phase on the γ-grain boundary, to enable a superplastic deformation. Here we will explain the reason-why β+y dual phase alloy is formed.

The γ phase is stable at high temperature for pure Ti and has a bcc crystal structure having deformability. Since pure Ti has α phase, hcp crystal structure under transformation temperature, which has poor deformability. So in the alloy design for Ti based alloy, elements which stabilize the β phase have been taken into account. The TiAl intermetallic compound (γ phase ), y single phase , has a poor deformability at room temperature, and even with use of slip dislocations activated at high temperatures, a tensile elongation only about 50% can be obtained at 1000° C. the range of the single phase composition of γ phase is about 49–55% Al at. % at room temperature, but this single phase region changes in a complicated manner as increasing temperature. The coexistence phase s in both sides of this single phase are $Ti_3Al(\alpha_2)$phase at the Ti excess side and $TiAl_2$ phase at the Al excess side. To improve the deformability, it is effective that the γ phase coexists with an $\alpha_2$-phase by selecting the composition as Ti excess side so that microstructure shows a layered structure consisting of γ phase and $\alpha_2$ phase (lamellar structure). Nevertheless, since the $\alpha_2$ phase in this dual phase region is transformed into the α phase at 1125° C. due to the eutectoid reaction (following reaction (1)), and further into the β phase at 1285° C. due to the peritectoid reaction (the following reaction (2)), the $\alpha_2$ phase has a poor stability at high temperature.

$$\alpha_2+\gamma\rightarrow\alpha \quad (1)$$

$$\alpha\rightarrow\beta+\gamma \quad (2)$$

The Cr alloying behavior in this invention is selected in such a way that the alloy composition proceeds toward substituting for Al by Cr. In the composition ratio of Ti to Al, Ti is selected to be excess and thus the alloy tend to form a lamellar structure (γ and $\alpha_2$). However, the continuation of the lamellar is partially broken in the heat treated state from the results of the transmission electron microscopic observation (EDX analysis) and this lamellar structure is clearly different from that one observed in the binary system, that is, stable lamellar structure. Namely, the $\alpha_2$ phase which constructs the lamellar structure does not form a perfect layer together with the matrix γ phase , but has an appearance in which the $\alpha_2$ phase exists in the form of slender islands floating on the γ phase . Further, Cr is enriched in the $\alpha_2$ phase of the discontinuous lamellar structure about four to five fled that of the matrix γ phase . This means that the addition of Cr lowers the stability of the lamellar, and also indicates easy occurrence of thermal transformation because the $\alpha_2$ phase cannot stably exist. According to the above-mentioned EDX analysis, the Al content in the $\alpha_2$ phase is markedly decreased as the amount of Cr is enriched and the $\alpha_2$ phase contains excess Ti. Accordingly, the volume percentage of the β phase formed by the above-mentioned reactions (1) and (2) increases drastically in comparison with that of the binary alloy. The ternary diagram of Ti-Al-Cr is already reported by J. A. Talor, et. al., (J. Met., 1953, pp. 253–256) up to 982° C. According to this diagram, the range of alloy composition in the present invention is in a γ phase region in the vicinity of β and γ dual phase region at 928° C. Although there have not been reported any phase diagrams at temperatures higher than the above, the range of the alloy composition of the present invention at temperatures above 982° C. can be concluded to be in the β and γ dual phase region from the facts that the β and γ dual phase region is shifted toward Ti rich and Al poor as the temperature is increased, according to the constitutional diagram of J. A.

Taylor et. al., and Cr is a $\beta$ phase stabilizing element for Ti alloys. Specifically, to obtain the $\beta$ and $\gamma$ dual phase region of the present invention, it is necessary to select the temperature region from not less than 1100° C., preferably at, not less than 1200° C. to lower than the solidus temperature. The reason why is as follows. If it is lower than this temperature region, the phase would become the $\gamma$ single phase in the range of the alloy composition of the present invention and the $\beta$ phase could not be formed. So that, it is impossible to obtain the $\beta$ and $\gamma$ dual phase which exhibits the superplasticity.

Further to precipitate the $\beta$ phase on the $\gamma$ phase grain boundary, it is necessary to recrystallize $\gamma$ grains and bread the initial discontinuous lamellar structure. At the working temperature and the working degree required for causing the recrystallization of the $\gamma$ phase , it is necessary for the $\beta$ phase formed by thermal deformation to be sufficiently endurable for the deformation by working, and it can be considered that the $\beta$ phase being subjected to the deformation in the grain growth stage of recrystallize $\gamma$ phase plays a roll as a barrier so that the $\beta$ phase is finally segregated to the $\gamma$ phase grain boundary. Specifically, as a working condition required for the recrystallization of the $\gamma$ phase , a working degree of not less than 60% is required at this temperature region. If the working degree is less than the above-mentioned, an non-crystallized region is formed and thus the $\beta$ phase remains in the $\gamma$ matrix, in that case we can not obtain the superplasticity behavior. On the other hand, if the strain rate is more than $5\times10^{-3}s^{-1}$, deformed texture induced by working is formed in addition to the recrystallized texture so that the $\beta$ phase cannot be segregated on the grain boundary. If the strain rate is not more than $5\times10^{-3}s^{-1}$, the fine-grains of the recryetallized $\gamma$ phase growth and the effect of the superplasticity by the fine-grains markedly lowers. Accordingly the superplasticity behavior at high temperatures as shown in the present invention could not be obtained.

Further, a sheath forging can be applied as a high temperature working under the following conditions. That is, a capsule is prepared using a $\beta$ Ti or $\alpha+\beta$ Ti alloy as a sheath material. The alloy of the present invention is inserted in the capsule, sealed with a lid, and then a sheath forging is carried out under a normal atmosphere at a forging temperature of more than 1100° C., preferably more than 1200° C., at an initial strain rate of not more than 0.5 $s^{-1}$, preferably not more than $5\times10^{-2}s^{-1}$, and more than $5\times10^{-5}s^{-1}$, and a working degree of more than 60% .

In related to the alloy composition, it needs $\beta$ phase stabilized elements at high temperature. If the amount of Cr added is more than 5 at. % , there appears some precipitations comprising Ti-Al-Cr ternary in the $\gamma$ matrix at the melt and heat treatment stages. In such cases, these precipitates still remains on the grain boundary even after hot working, which could be obstacles to superplasticity. Conversely, if the amount of Cr is less than 1 at. % , the $\alpha_2$ phase formed in the melt and heat treatment stages has too small content of Cr and too high content of Al. Accordingly, even after the transformation carried out thereafter, the $\beta$ phase cannot be formed with a sufficient volume and recrystallized fine microstructure can not be obtained by the thermomechanical treatment at high temperatures. This results in a recrystallized coarse grain of a $\gamma$ phase with insufficient amount of $\beta$ phase and accordingly we can not get superplasticity behavior. Further, if the Ti concentration is less than 47.5 at % , it leads to $\gamma$ phase stable region and it is impossible to form the grain boundary $\beta$ phase which needs to realize the surperplasticity. Conversely, if the concentration of Ti is more than 52 at. % , the volume rate of the $\beta$ phase is increased and high temperature strength intrinsically possessed by the TiAl based intermetallic compound is lowered. In addition to these criteria, it is necessary to define Al concentration by the following inequality: Cr amount+2 Ti amount$\geqq$100% , because the reactions represented by above (1) and (2) can not be accursed in the present ternary system, unless the amount of Al is always lower than that of Ti.

As described above, it is clear that the $\beta$ phase in the present invention remains stable with increasing temperature, that the coarsening of the matrix $\gamma$ grains can be suppressed by the grain boundary $\beta$ phase , which is different from the binary and that in order to improve the hot workability, which is the object of the present invention, we need grain boundary segregation of phase decides grain refinement. According to the present work, it is preferable the grain boundary occupied ratio of the $\beta$ phase existing on the grain boundary (ratio of the occupied aria by $\beta$ phase based on the whole crystal grain boundary) is 20 to 100% and the volume percentage of the $\beta$ phase is from 3 to 20% . The thermomechanical treatment conditions which satisfy these microstructure are described in claims 4 and 5.

On the other hand, concerning the grain diameter, since the mechanism for expressing superplasticity of the present invention is a moderation of the plastic strain of the matrix phase by the $\beta$ phase deformation, it is Just necessary to attain a micro structure in which the $\beta$ phase is precipitated on the $\gamma$ phase grain boundary. Where the grain diameter of the $\gamma$ grain is large, however, the high strength possessed by the TiAl based intermetallic compound cannot be obtained so it is necessary to get $\gamma$ fine crystallized grains to some extent.

Namely, the $\gamma$ grain sizes are defined as 30 $\mu$m, which satisfies the Hall-Perch relationship (strength is proportional to ½nd the power of the reciprocal of the grain size) and at the same time attain superplasticity by precipitating of $\beta$ phase at grain boundary. That is, the upper limit of the grain diameter is determined as 30 $\mu$m, because the strength is lowered over the entire temperature range when the grain size is larger than 30 $\mu$m.

As described above, in order to obtain a $\beta$ and $\gamma$ dual phase alloy having a superplastic behavior, it is necessary to select such alloy composition that will stabilize the $\beta$ phase and to carry out thermomechanical treatment at high temperatures that $\beta$ phase will segregate at the grain boundary.

The present invention will now be described in detail with reference to the following examples, that by no means limit the scope of the invention.

EXAMPLE 1

Figure 4:
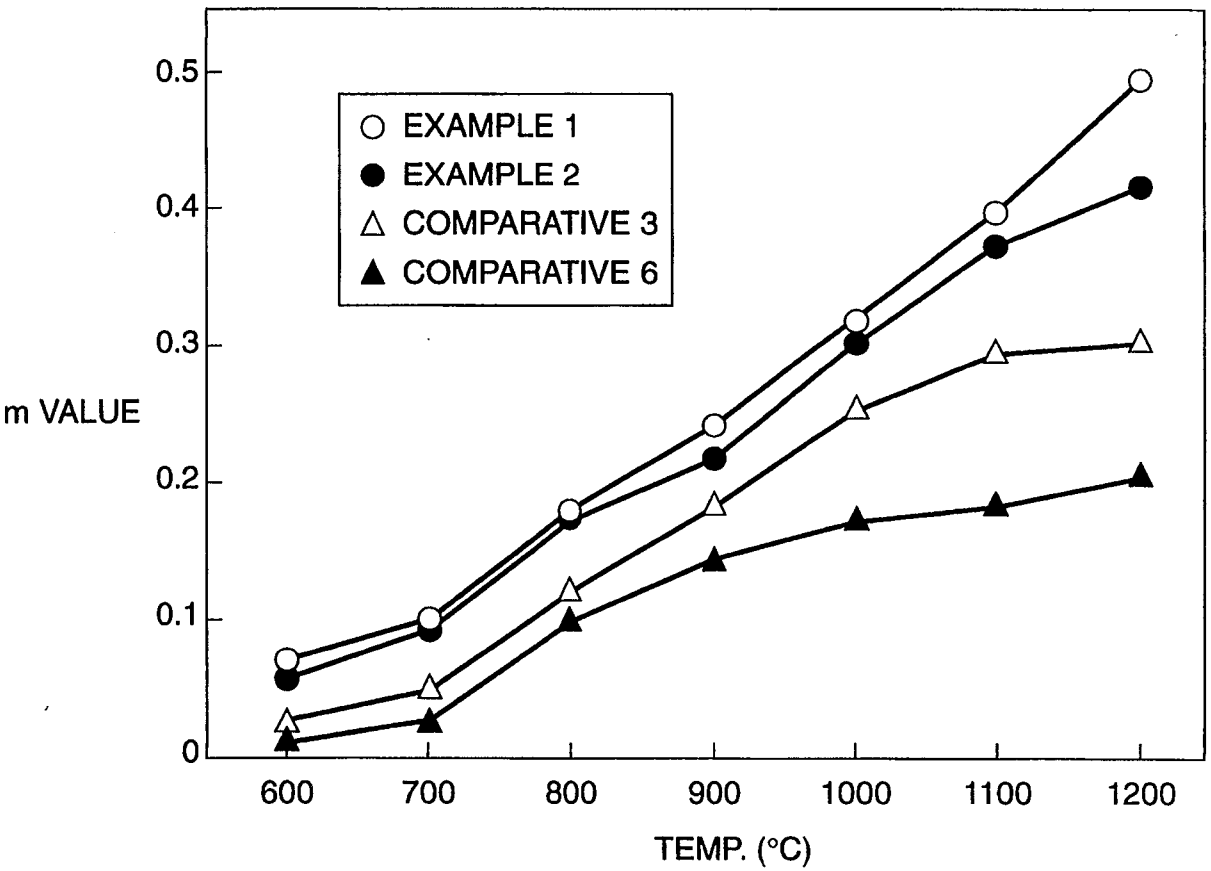
FIG. 4 shows a temperature dependency of m values for the present invention alloy and the comparative alloy.

Intermetallic compound 50.8% Ti-46.1% Al-3.1% Cr in atomic:

Isothermal forged at an initial strain rate of $5\times10^{-4}s^{-1}$, at working degree of 60% and at 1300° C.:

High purity Ti (99.9 wt % ), Al (99.99 wt % ) and Cr (99.3 wt % ) were used as starting materials for melting and an ingot of the above-captioned alloy composition Cr-added intermetallic compound having a size of about 80 mm diameter$\times$300 mm was prepared by plasma arc melting method. When the ingot was homogenized by the heat treatment at 1050° C. for 96 hours in a vacuum, the equiaxed microstructure having 80 μm grain sizes was obtained. Table 1 summarizes chemical analysis results after homogeneous heat treatment. Cylindrical ingots having an 35 mm diameter×42 mm height were cut from this ingot by discharge spark cutting machine and then isothermally forged. Isothermal forging was carried out at an initial strain rate of $5\times10^{-1}s^{-1}$, at the sample temperature of 1300° C. and at a reduction rate of 60% in a vacuum. Microphotograph of isothermal forged sample is shogun in FIG. 1 (*a*). In addition to the equiaxed fine grains having an average grain size of 18 μm, the grain boundary secondary phase having a thickness of less than several microns is observed. From the as-forged ingot material, tensile test specimens having a gauge section size of $11.5\times3\times2$ mm$^3$ were cut by wire cutting and the tensile test was carried out by various strain rates and test temperatures. Each of the specimens was tensile tested at a constant temperature and at a constant strain rate until it was fractured to prepare an true-stress true-strain curve. As one example of the results showing a superplasticity, a tensile elongation of about 480% at 1200° C. and at a strain rate of $5\times10^{-4}s^{-1}$ was obtained. In the samples exhibiting a superplasticity, it was observed that the gauge portion was uniformly deformed without necking and that the grain boundary secondary phase was elongated after testing. The strain rate sensitivity factor (m value) calculated from the strain-dependency of the stress was 0.49 at a true strain value of 0.1 and at 1200° C. The m values were calculated from the true-stress true-strain curve and the temperature dependencies of the m values are shown in FIG. 4. From this figure, it is clear that at higher temperature range than 1000° C. the m value exceeds 0.3 which is criterion for superplasticity. FIG. 4 also shows the results of Comparative Examples 3 and 6 described later.

Figure 5:
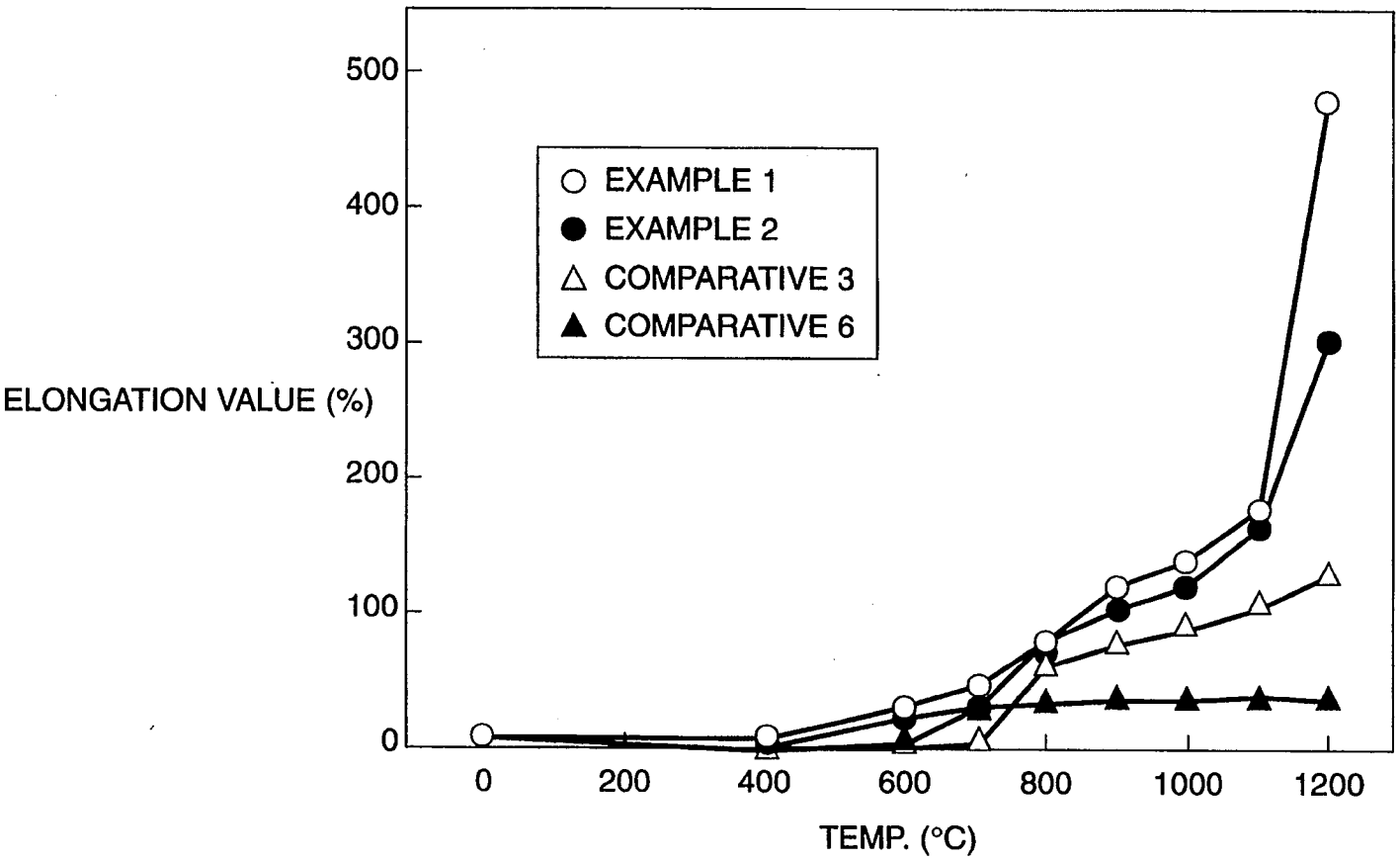
FIG. 5 shows temperature dependency of the tensile elongation of the present invention alloy and the comparative alloy.
Figure 6:
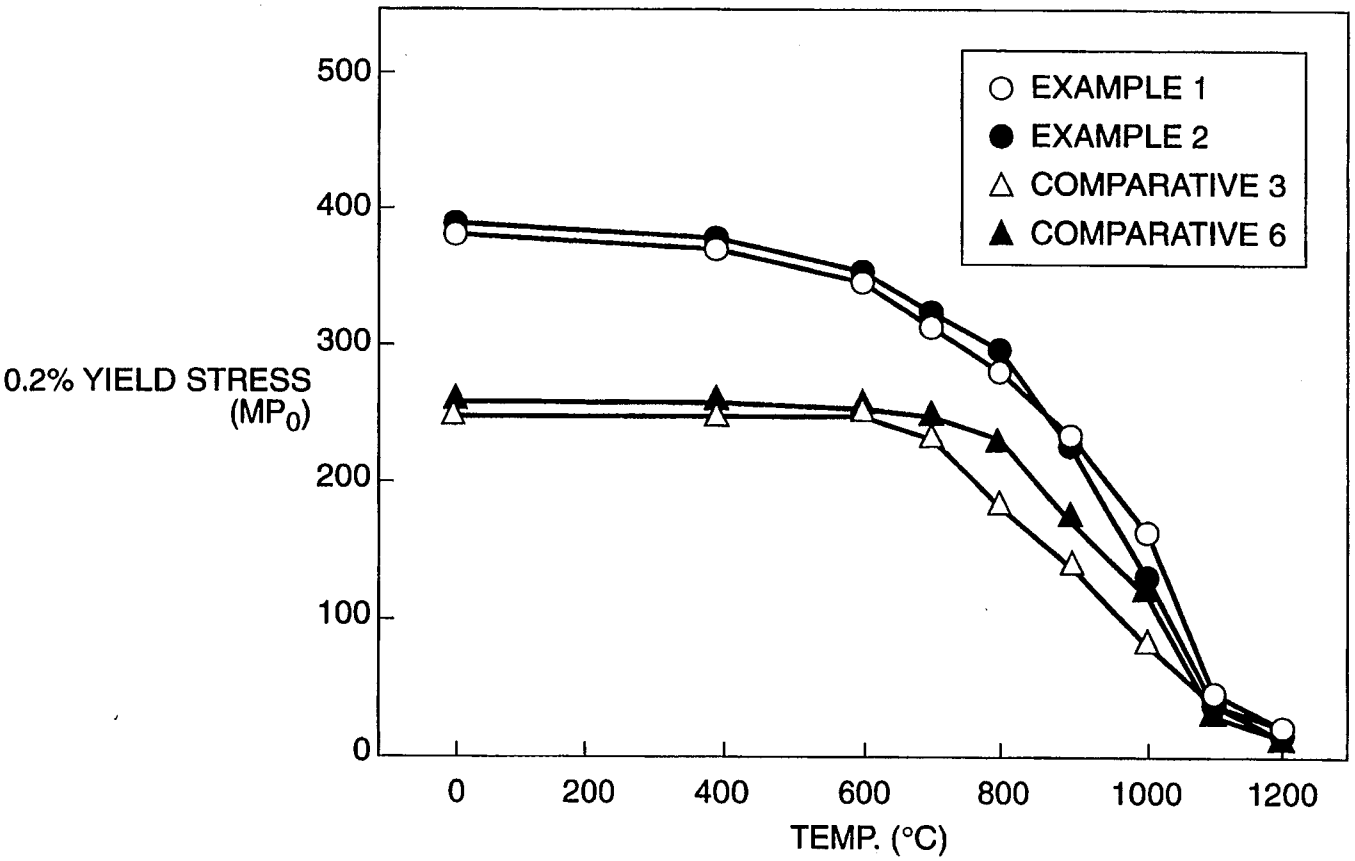
FIG. 6 shows temperature dependency of yield stress of the present invention alloy and the comparative alloy.

As results of the high temperature tensile tests, the temperature-dependencies of tensile elongation and the temperature-dependencies of 0.2% yield stress are shown in FIGS. 5 and 6, respectively. FIGS. 5 and 6 also show the results of Comparative Examples 3 and 6 described later. From FIG. 5, it is found that tensile elongation increased dramatically at temperatures above 1000° C. As clear from FIG. 6, it is found that the yield stress of Example are very high over the entire temperature region in comparison with those of Comparative Examples, suggesting that the microstructure controlling is effective too improving both elongation and the strength at high temperatures.

TABLE 1

| Chemical analysis result of Cr-added TiAl based Intermetallic Compound (the present alloy) | | | | | | |
|---|---|---|---|---|---|---|
| Ti | Al | Cr | O | N | C | Fe |
| 50.8 | 46.1 | 3.10 | 0.009 | 0.007 | 0.008 | 0.02 |

Ti, Al and Cr and expressed in at % and 0, N, C and Fe in wt % .

EXAMPLE 2

Intermetallic compound 50.8 Ti-46.1% Al-3.1% Cr in atomic Isothermal forged at an initial strain rate of $5\times10^{-4}s^{-1}$, at working degree of 60% and at the temperature of 1200° C.:

A sample contained the same composition and carried out the same heat treatment as in Example 1 was isothermal forged at an initial strain rate of $5\times10^{-4}s^{-1}$, at sample temperature of 1200° C. and at a reduction rate of 60% and resulted in equiaxed fine microstructure having an average grain sizes of 12 μm with the secondary phase having a thickness of less than several microns at grain boundary. A tensile test high temperatures were conducted by the same method as in example 1 and a true-stress true-strain curve was prepared. As one example of the results showing a superplasticity, a tensile elongation of about 310% at 1200° C. and at a strain rate of $5\times10^{-4}s^{-1}$ was obtained. In the samples exhibiting superplasticity, it was observed that the gauge portion was uniformly deformed without necking and that the grain boundary secondary phase was elongated after testing. The strain rate sensitivity factor, m value, calculated from the strain-dependency of the stress was found to be 0.41 at a true strain of 0.1 and at 1200° C. The m values were calculated from the above true-stress true-strain curve and the temperature dependencies of the m values are shown in FIG. 4. From this figure, it is clear that at higher temperature range than 1000° C. the m value exceeds 0.3 which is criterion for superplasticity.

As results of the high temperature tensile tests, the temperature dependencies of tensile elongation and the temperature dependencies of 0.2% yield stresses are shown in FIGS. 5 and 6 together with Example 1, respectively. From FIG. 5, it is found that tensile elongation increased dramatically at temperatures above 1000° C. As clear from FIG. 6, it is found that the yield stress of Example are very high over the entire temperature region in comparison with those of Comparative Examples, suggesting that the microstructure controlling is effective for improving both elongation and strength at high temperatures.

COMPARATIVE EXAMPLE 1

Intermetallic compound 50.8% Ti-46.1% Al-3.1% Cr in atomic: Isothermal forged at an initial strain rate of $5\times10^{-4}s^{-1}$, at a working degree of 60% and at the temperature of 900° C.:

A sample contained the same composition and carried out the same heat treatment as in Example 1 was isothermal forged at an initial strain rate of $5\times10^{-4}s^{-1}$, at sample temperature of 900° C. and at a reduction rate of 60% and resulted in mixed grain structure having about 10 to 30 μm grain sizes, heterogeneous dispersion of secondary phase in matrix and a discontinuous lamellar structure. A tensile test at high temperatures were carried out by the same method as in Example 1 and an true-stress true-strain curve was prepared. A tensile elongation of about 118% with necking was attained at 1200° C. and at strain rate of $5\times10^{-4}s^{-1}$. The strain rate sensitivity factor (m value) calculated from the strain-dependency of the stress was found to be 0.29 at a true strain of 0.1 and at 1200° C. The m value are calculated from the true-stress true-strain curve and the temperature dependencies of the m value are shown in Table 2 together with the results of Examples.

TABLE 2

| m Values of Example and Comparative Example | | | | | |
|---|---|---|---|---|---|
| | 800° C. | 900° C. | 1000° C. | 1100° C. | 1200° C. |
| Example 1 | 0.18 | 0.24 | 0.31 | 0.39 | 0.49 |
| Example 2 | 0.15 | 0.22 | 0.30 | 0.37 | 0.41 |
| Comparative Example 1 | 0.11 | 0.16 | 0.25 | 0.26 | 0.29 |
| Comparative Example 2 | 0.10 | 0.14 | 0.22 | 0.25 | 0.25 |

TABLE 2-continued

| | m Values of Example and Comparative Example | | | | |
|---|---|---|---|---|---|
| | 800° C. | 900° C. | 1000° C. | 1100° C. | 1200° C. |
| Comparative Example 3 | 0.12 | 0.18 | 0.25 | 0.29 | 0.30 |
| Comparative Example 4 | 0.11 | 0.16 | 0.22 | 0.25 | 0.27 |
| Comparative Example 5 | 0.09 | 0.12 | 0.16 | 0.18 | 0.22 |
| Comparative Example 6 | 0.10 | 0.14 | 0.17 | 0.18 | 0.20 |

As results of tensile test at high temperatures the tensile elongation and the 0.2% yield stresses are shown in Table 3 together with those of the Examples. As seen from this table, the comparative results did not show a marked improvement of tensile elongation even at a temperature above 1000° C. as observed in Examples and it is clear that the yield stresses were inferior to those of the Examples over the entire temperature region.

TABLE 3

| | High temperature tensile test results of Example and Comparative Example (strain rate: $5 \times 10^{-4}s^{-1}$) | | | | | | | | | |
|---|---|---|---|---|---|---|---|---|---|---|
| | 600° C. | | 800° C. | | 1000° C. | | 1100° C. | | 1200° C. | |
| | $\sigma_Y$ | $\epsilon$ | $\sigma_Y$ | $\epsilon$ | $\sigma_Y$ | $\epsilon$ | $\sigma_Y$ | $\epsilon$ | $\sigma_Y$ | $\epsilon$ |
| Ex. 1 | 353 | 35 | 290 | 90 | 162 | 143 | 41 | 185 | 13 | 488 |
| Ex. 2 | 372 | 26 | 298 | 87 | 133 | 125 | 33 | 176 | 15 | 310 |
| Comp. Ex. 1 | 320 | 10 | 257 | 66 | 97 | 79 | 24 | 87 | 13 | 118 |
| Comp. Ex. 2 | 342 | 13 | 277 | 81 | 105 | 92 | 23 | 122 | 12 | 140 |
| Comp. Ex. 3 | 255 | 4 | 190 | 77 | 92 | 98 | 26 | 110 | 12 | 135 |
| Comp. Ex. 4 | 351 | 3 | 287 | 45 | 101 | 80 | 29 | 96 | 12 | 125 |
| Comp. Ex. 5 | 338 | 7 | 252 | 59 | 112 | 66 | 28 | 80 | 13 | 88 |
| Comp. Ex. 6 | 260 | 4 | 238 | 38 | 125 | 40 | 26 | 40 | 12 | 42 |

Units:
$\sigma_Y$ (yield stress) MPa,
$\epsilon$ (tensile elongation) %.

COMPARATIVE EXAMPLE 2

Intermetallic compound 50.8% Ti-46.1% Al-3.1% Cr in atomic: Isothermal forged at an initial strain rate of $5\times10^{-4}s^{-1}$, at working degree of 40% and at the temperature of 1200° C.:

A sample contained the same composition and carried out the Same heat treatment as in Example 1 was isothermal forged at an initial strain rate of $5\times10^{-4}s^{-1}$, at sample temperature of 1200° C. and at a reduction rate of 40% and resulted in mixed grain structure having about 15 to 80 μm grain sizes, recrystallized zone and a secondary phase partially precipitated on the grain boundary. A tensile test at high temperatures were carried out by the same method as in Example 1 and true-stress true-strain curve was prepared. A tensile elongation of about 140% with necking was attached at 1200° C. and at a strain rate of $5\times10^{-4}s^{-1}$. The strain rate sensitivity factor (m value) calculated from the strain-dependency of the stress was found to be 0.25 at a true-strain of 0.1 and at 1200° C. From the true-stress true-strain curve, the m values were calculated and the temperature dependencies of the m values are shown in Table 2 together with the results of the Examples.

As results of tensile test at high temperatures, the tensile elongation and 0.2% yield stresses are shown in Table 4 together with those of the Examples. As seen from this table, the comparative results did not show a marked improvement of tensile elongation even at a temperature of 1000° C., as observed in Examples and it is clear that the yield stresses were inferior to those of the Examples over the entire temperature region.

COMPARATIVE EXAMPLE 3

Intermetallic compound 50.4% Ti-49.6% Al in atomic: Isothermal forged at an initial strain rate of $5\times10^{-4}s^{-1}$, at working degree of 60% and at the temperature of 1200° C.:

High purity Ti (99.9 wt % ) and Al (99.99 wt % ) were used as starting materials for melting and the ingot of the above binary/TiAl based intermetallic compound alloy having a size of about 80 mm diameter×300 mm was prepared by plasma arc melting. BY heat treatment for homogenization at 1050° C. for 96 hours in vacuum, the equiaxed microstructure having 120 μm grain sized was obtained. Table 4 summarizes chemical analysis results after heat treatment for homogenization. Cylindrical ingot having a 35 mm diameter×42 mm height was cut from the above ingot by discharge spark cutting machine and then isothermal forged. Isothermal forging was carried out at an initial strain rate of $5\times10^{-4}s^{-1}$, at the sample temperature of 1200° C. and at a reduction rate of 60% in vacuum in. The microstructure comprising eguiaxed refined grains having of 25 μm average grain sizes was observed. Tensile tests at high temperatures was carried out by the same method as in Example 1, and true-stress true-strain curve was prepared. Tensile elongation of about 135% with necking at 1200° C. and at a strain rate of $5\times10^{-4}s^{-1}$ was obtained. The strain rate sensitivity factor (m value) calculated from the strain-dependency of the stress was 0.30 at a true stress value of 0.1 and at 1200° C. The m values were calculated from the true-stress true-strain curve and the temperature dependencies of the m values are shown in Table 2 together with the results of the Examples.

TABLE 4

| Chemical analysis result of Binary TiAl Intermetallic Compound | | | | | |
|---|---|---|---|---|---|
| Ti | Al | O | N | C | Fe |
| 50.4 | 49.6 | 0.007 | 0.005 | 0.006 | 0.02 |

Ti and Al are expressed in at % , and O, N, C, and Fe in wt % .

As results of the high temperature tensile tests, tensile elongation and 0.2% yield stresses are shown in Table 3 together with those of Examples. As seen from this table, the comparative results did not show the marked improvement of tensile elongation even at temperature above 1000° C., as observed in Examples and it is clear that the yield stresses were inferior to those of the Examples over the entire temperature region.

COMPARATIVE EXAMPLE 4

Intermetallic compound 46.4% Ti-50.8% Al-2.8% Cr in atomic: Isothermal forged at an initial strain rate of $5\times10^{-4}s^{-1}$, at a working degree of 60% and at the temperature of 1200° C.:

High purity Ti (99.9 wt % ), Al (99.99 wt % ) and Cr (99.3% ) were used as starting materials for melting and the ingot of the above binary TiAl based intermetallic compound alloy having a size of about 80 mm diameter×300 mm was prepared by plasma arc melting. By heat treatment for homogenization at 1050° C. for 96 hours in vacuum, the equiaxed microstructure having 95 μm grain sized was obtained. Table 5 summarizes chemical analysis results after heat treatment for homogenization. Cylindrical ingot having a 35 mm diameter×42 mm height was cut from the above ingot by discharge spark cutting machine and then isothermal forged. Isothermal forging was carried out at an initial strain rate of $5\times10^{-4}s^{-1}$, at the sample temperature of 1200° C. and at a reduction rate of 60% in vacuum. The microstructure was composed of a mixed grain structure having 15–35 μm grain sizes and a trace amount of the secondary phase was observed to be precipitated on grain boundary, but this amount of the second phase was much smaller than that of the Examples. High temperature tensile test was carried out by the same method as in Example 1 and true-stress true-strain curve was prepared. Tensile elongation of about 125% with necking at 1200° C. and at a strain rate of $5\times10^{-4}s^{-1}$ was obtained. The strain rate sensitivity factor (m value) calculated from the strain-dependency of the stress was found to be 0.27 at a true strain value of 0.1 and at 1200° C. From the true-stress true-strain curve the m value was calculated and the temperature dependencies of the m value are shown in Table 2 together with the results of Examples.

As results of the high temperature tensile tests, tensile elongation and 0.2% yield stresses are shown in Table 3 together with those of the Examples. As seen from this table, the comparative results did not show the marked improvement of tensile elongation even at temperature above 1000° C. as observed in Examples and it is clear that the yield stresses were inferior to those of the Examples over the entire temperature region.

TABLE 5

| Chemical analysis result of Cr-added TiAl based Intermetallic Compound (the present alloy) | | | | | | |
|---|---|---|---|---|---|---|
| Ti | Al | Cr | O | N | C | Fe |
| 46.4 | 50.8 | 2.80 | 0.009 | 0.007 | 0.008 | 0.02 |

Ti, Al and Cr are expressed in at % , and O, N, C and Fe in wt %.

COMPARATIVE EXAMPLE 5

Intermetallic compound 50.8% Ti-46.1% Al-3.1% Cr in atomic: Isothermal forged at an initial strain rate of $5\times10^{-2}s^{-1}$ at a working degree of 60% and at the temperature of 1200° C.:

A sample containing the same components and subjected to the same heat treatment as in Example 1 was isothermal forged at an initial strain rate of $5\times10^{-2}s^{-1}$, at the sample temperature of 1200° C. and at a reduction rate of 60% in vacuum atmosphere, and resulted in heterogeneous microstructure composed of a mixed grain structure having about 10 to 30 μm grain sizes and deformation structure was obtained and grain boundary secondary phase observed in a much smaller amount in comparison with Example 1, which secondary phase was also observed in matrix. High temperature tensile test was carried out by the same method as in Example 1, and true-stress true-strain curve was prepared. Tensile elongation of about 88% with necking at 1200° C. and at a strain rate of $5\times10^{-4}s^{-1}$ was obtained. The strain rate sensitivity factor (m value) calculated from the strain-dependency of the stress was found to be 0.22 at true strain of 0.1 and at 1200° C. From the true-stress true-strain curve, the m value was calculated and the temperature dependencies of the m value are shown in Table 2 together with the results of Examples.

As results of the high temperature tensile tests, tensile elongation and 0.2% yield stresses are shown in Table 3 together with those of the Examples. As seen from this table, the comparative results did not show the marked improvement of tensile elongation even at temperature of 1000° C. as observed in Examples and it is clear that the yield stresses were inferior to those of the Examples over the entire temperature region.

COMPARATIVE EXAMPLE 6

Intermetallic compound 50.8% Ti-46.1% Al-3.1% Cr in atomic: Homogenized heat treated material:

A sample containing the same components and subjected to the see heat treatment as in Example composed of an equiaxed grain having about 80 μm diameter in which the secondary phase was heterogeneously dispersed in the matrix and discontinuous lamellar phase . High temperature tensile test was carried out by the same method as in Example 1, and true-stress true-strain curve was prepared. Tensile elongation of about 42% with necking at 1200° C., at a strain rate of $5\times10^{-4}s^{-1}$ was obtained. The strain rate sensitivity factor (m value) calculated from the strain-dependency of the stress of 0.20 Was obtained at true strain of 0.1 and at 1200° C. From the true-stress true-strain curve, the m values were calculated and the temperature dependencies of the m value are shown in Table 2 together with the results of Examples.

As results of the high temperature tensile test, tensile elongation and 0.2% yield stresses are shown in Table 3 together with those of the Examples. As seen from this table, the comparative results did not show a marked improvement of tensile elongation even at temperature of 1000° C. as observed in Examples and it is clear that the yield stresses were inferior to those of the Examples over the entire temperature region.

As explained above, since the TiAl based alloy of the present invention exhibits an outstanding superplasticity, a complicated shape can be formed by one process. Accordingly, because the fields of application of the alloy can be greatly enlarged, the present invention has vast industrial effects.

We claim:

1. A process for producing γ and β dual phase TiAl based intermetallic compound alloy, which comprises basic compositions in the atomic rate:

$Ti_yAlCr_x$ wherein $1\% \leqq X \leqq 5\%$, $47.5\% \leqq Y \leqq 52\%$, and $X+2Y \geqq 100\%$ which is subjected to homogeneous heat treatment at a temperature between 1000° C. and the solids temperature (°C) for 2 to 100 hours and then applying thermochemical treatment at a temperature of more than 1100° C.

2. The process according to claim 1, wherein the thermomechanical treatment is an isothermal forging which is carried out at initial strain rate of slower than $5\times10^{-3}s^{-1}$ and at working degree of more than 60%, at temperature of more than 1100° C.

3. The process according to claim 1, Wherein the thermomechanical treatment is the isothermal forging which is carried out at initial strain rate of between $5\times10^{-4}S^{-1}$ and $5\times10^{-3}S^{-1}$ and at working degree of more than 60% and at temperature of between 1200° C. and the solid phase line temperature (°C.).

* * * * *